US011242212B2

(12) United States Patent
Nakanosono

(10) Patent No.: US 11,242,212 B2
(45) Date of Patent: Feb. 8, 2022

(54) SHEET STORAGE APPARATUS, IMAGE FORMING APPARATUS, AND METHOD FOR SHEET STORAGE APPARATUS

(71) Applicant: CANON KABUSHIKI KAISHA, Tokyo (JP)

(72) Inventor: Shogo Nakanosono, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/352,662

(22) Filed: Mar. 13, 2019

(65) Prior Publication Data

US 2019/0300305 A1 Oct. 3, 2019

(30) Foreign Application Priority Data

Mar. 29, 2018 (JP) ..... JP2018-065367

(51) Int. Cl.

| | |
|---|---|
| ***B65H 1/26*** | (2006.01) |
| ***B65H 1/04*** | (2006.01) |
| ***G03G 21/16*** | (2006.01) |
| ***G03G 15/00*** | (2006.01) |

(52) U.S. Cl.

CPC ..... *B65H 1/266* (2013.01); *G03G 15/6502* (2013.01); *G03G 21/1647* (2013.01)

(58) Field of Classification Search

CPC ..... B65H 1/04; B65H 2405/121; B65H 2405/31; B65H 2405/32; B65H 2405/324; B65H 2402/64; B65H 1/266; A47B 88/467; G03G 21/1647; G03G 15/6502

USPC ..... 312/332.1, 319.1

See application file for complete search history.

(56) References Cited

U.S. PATENT DOCUMENTS

| | | | | |
|---|---|---|---|---|
| 5,207,781 | A * | 5/1993 | Rock | E05B 65/46 312/319.1 |
| 5,868,478 | A * | 2/1999 | Yemini | A47B 95/02 292/107 |
| 7,604,232 | B2 * | 10/2009 | Nakashima | B65H 1/26 271/164 |
| 8,061,707 | B2 * | 11/2011 | Sugishima | B65H 1/266 271/164 |
| 8,408,535 | B2 * | 4/2013 | Miki | B65H 1/266 271/162 |
| 8,428,506 | B2 * | 4/2013 | Miki | B65H 1/266 399/393 |

(Continued)

FOREIGN PATENT DOCUMENTS

| | | | |
|---|---|---|---|
| JP | 08319040 | A * | 12/1996 |
| JP | 2006327823 | A | 12/2006 |

(Continued)

*Primary Examiner* — Luis A Gonzalez

(74) *Attorney, Agent, or Firm* — Canon U.S.A., Inc. I.P. Division

(57) ABSTRACT

A sheet storage apparatus includes a storage unit configured to store sheets, a biasing unit configured to apply a biasing force to the storage unit so that the storage unit is biased toward a mounting position, and a regulating unit configured to be located at a first position at which movement of the storage unit in a drawing out direction is regulated and a second position at which movement of the storage unit from the mounting position in the drawing out direction is permitted. The regulating unit is moved from the first position to the second position in response to an operation by an operator who operates a handle.

7 Claims, 8 Drawing Sheets

(56) References Cited

U.S. PATENT DOCUMENTS

| | | | | |
|---|---|---|---|---|
| 2004/0251597 | A1* | 12/2004 | Ito | B65H 1/04 271/145 |
| 2016/0221771 | A1* | 8/2016 | Matsushima | B65H 1/266 |
| 2016/0334745 | A1* | 11/2016 | Kwon | G03G 21/1695 |
| 2018/0127222 | A1* | 5/2018 | Kuno | B65H 1/04 |

FOREIGN PATENT DOCUMENTS

| | | | |
|---|---|---|---|
| JP | 2010064811 | A | 3/2010 |
| JP | 2011037540 | A | 2/2011 |

* cited by examiner

FIRST POSITION

SECOND POSITION

SHEET STORAGE APPARATUS, IMAGE FORMING APPARATUS, AND METHOD FOR SHEET STORAGE APPARATUS

FIELD

The present disclosure relates to a sheet storage apparatus for storing a sheet, an image forming apparatus and a method for the sheet storage apparatus.

DESCRIPTION OF THE RELATED ART

Conventionally, a cassette for storing sheets us supported by an apparatus main body so as to be drawn out for replenishment of sheets. In order to improve mounting operability of a cassette with respect to an apparatus main body, for example, Japanese Patent Application Laid-Open No. 2006-327823 describes an apparatus which includes a retraction unit for retracting a cassette to a predetermined position (a mounting position) in a case where the cassette is mounted on the apparatus main body. A retraction force of the retraction unit is applied to the cassette to prevent the cassette (a storage unit) from springing out from the apparatus main body. However, for example, in a case where the apparatus main body is transported and moved, there is a risk that the cassette springs out from the apparatus main body due to an inertial three and an impact caused by transportation and movement. In such a case, transportation work may be interfered.

SUMMARY

According to an aspect of the present disclosure, a sheet storage apparatus includes an apparatus main body, a storage unit configured to store sheets and to be moved with respect to the apparatus main body so as to be drawn out from a mounting position in a drawing out direction, a biasing unit configured to apply a biasing force to the storage unit to bias the storage unit toward the mounting position, a regulating unit configured to regulate movement of the storage unit in the drawing out direction, and a handle provided on the storage unit, wherein the regulating unit is configured to be located at a first position at which movement of the storage unit in the drawing out direction is regulated and a second position at which movement of the storage unit from the mounting position in the drawing out direction is permitted, and wherein the regulating unit is moved from the first position to the second position in response to receiving an operation of an operator who operates the handle.

Further features of the present disclosure will become apparent from the following description of embodiments with reference to the attached drawings.

DESCRIPTION OF THE EMBODIMENTS

Various embodiments of an image forming apparatus to which the present disclosure is applied will be described in detail below with reference to the attached drawings.

Figure 1A:
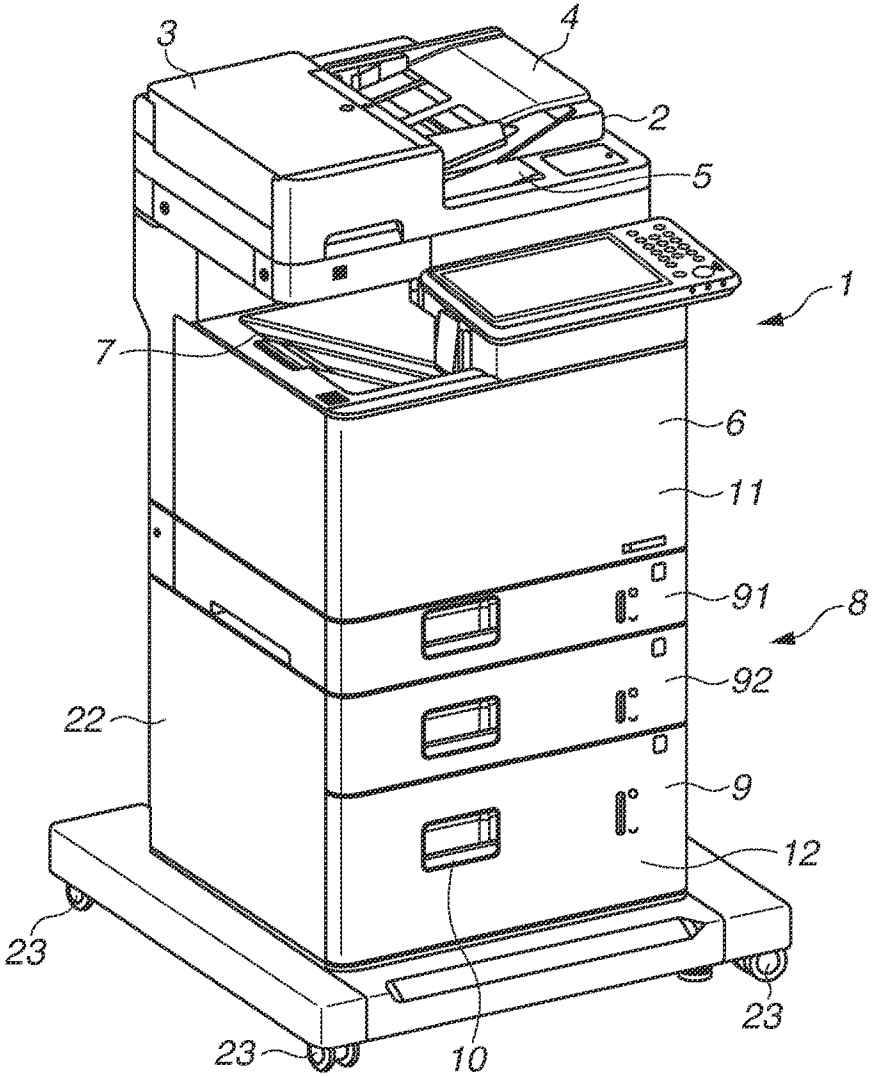
FIGS. 1A and 1B are perspective views of an image forming apparatus.
Figure 1B:
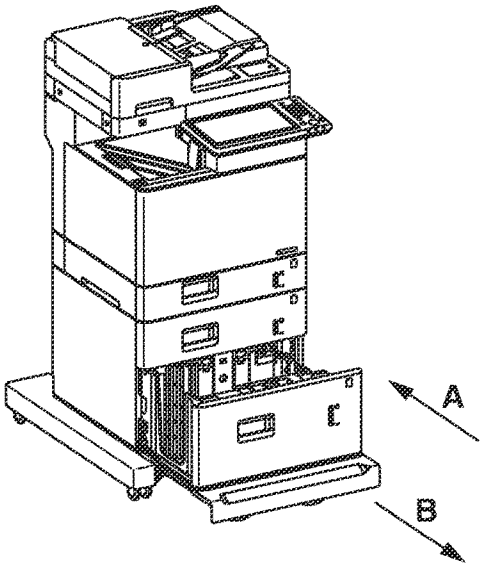

FIGS. 1A and 1B are top perspective views of an image forming apparatus 1. An image reading apparatus 2 is arranged on an upper part of the image forming apparatus 1. A recording unit 6 which records an image on a sheet and a feeding unit 8 which feeds a sheet to the recording unit 6 are arranged below the image reading apparatus 2.

The image reading apparatus 2 includes a flat-bed scanner mechanism and an automatic document feeder (ADF) 3. The flat-bed scanner mechanism includes a unit which reads a book-type document or a sheet-type document set on a platen. The ADF 3 reads a sheet-type document set on a document tray 4 while conveying the sheet-type document and discharges the document to an ADF discharge tray 5.

The recording unit 6 of the image reading apparatus 2 records an image on a sheet (recording paper) using an electrophotographic method. The recording unit 6 discharges the sheet on which the image is recorded to a discharge tray 7.

Figure 2:
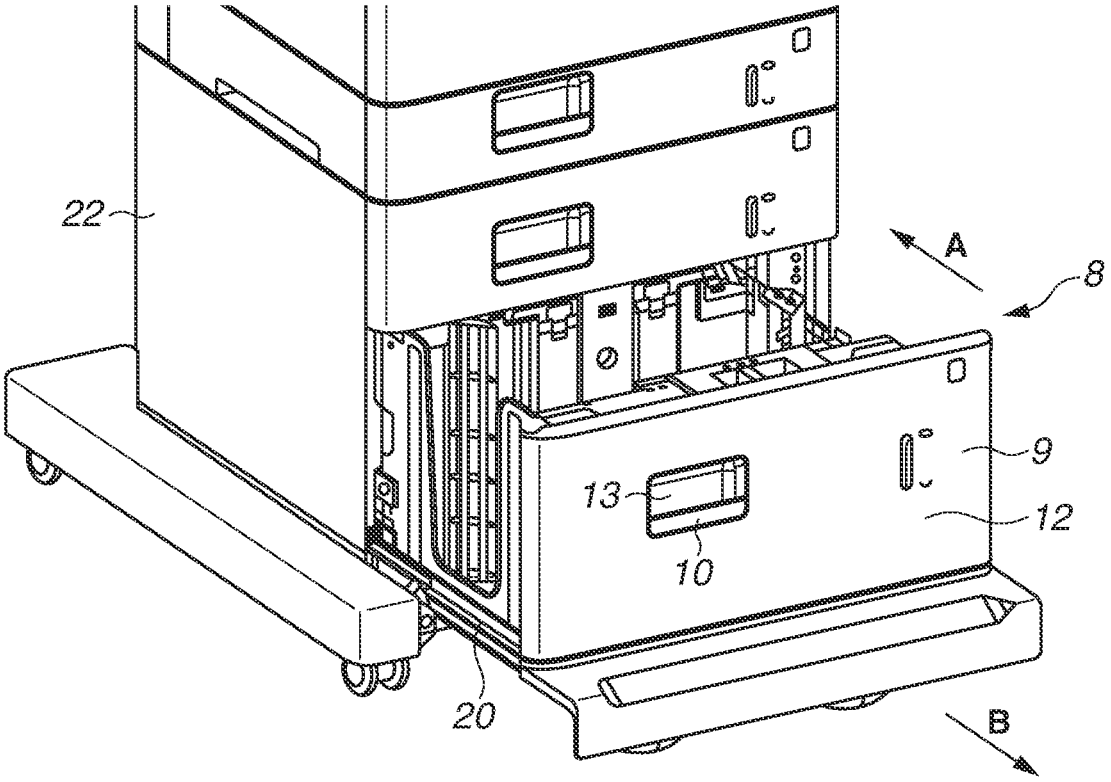
FIG. 2 is an enlarged view of a state in which a cassette is drawn out.

The feeding unit 8 is arranged below the recording unit 6 so as to feed a sheet to the recording unit 6. The feeding unit 8 includes a first cassette (a storage unit) 9 which stores a sheet. The first cassette 9 is supported by an apparatus main body 22 in a drawable manner. In a case where the first cassette 9 is replenished with sheets, an operator can draw out the first cassette 9 in a front direction (a drawing out direction B) of the image forming apparatus 1 by holding a handle 10 with his/her fingers, FIGS. 1B and 2 illustrate a state in which the first cassette 9 is drawn out to the drawing out direction B.

The feeding unit 8 feeds the sheet stored in the first cassette 9 to the recording unit (image forming unit) 6 in a state in which the first cassette 9 is located at a mounting position illustrated in FIG. 1A. An operator stores sheets in the first cassette 9 in a state in which the first cassette 9 is drawn out to the drawing out direction B as illustrated in FIGS. 1B and 2. The operator pushes the first cassette 9 in the state in FIG. 1B to a mounting direction A, and thus the first cassette 9 is moved to the mounting position illustrated in FIG. 1A.

A second cassette (another storage unit) 91 and a third cassette 92 which store sheets are arranged above the first cassette 9. The second cassette 91 and the third cassette 92 can be drawn out in the drawing out direction B which is a front of the image forming apparatus 1 so as to be replenished with sheets. The second and the third cassettes 91 and 92 can each store 50 sheets therein which are less than the number of sheets that the first cassette 9 can store (100 sheets).

Guide rails 20 (see FIG. 2) for holding the first cassette 9 are provided on side surfaces of the first cassette 9 so as to move the first cassette 9 while horizontally retaining the first cassette 9 in a case where the first cassette 9 is drawn out in the drawing out direction B or inserted in the mounting direction A. The apparatus main body 22 supports the guide rails 20, and thus the first cassette 9 can slide.

The configuration is described as an example in which the feeding unit 8 is arranged below the recording unit 6 as a part of the image forming apparatus 1 as a sheet storage apparatus. However, the feeding unit 8 can be an optional apparatus (the sheet storage apparatus) which is dedicated to feeding and is freely detachable to the image forming apparatus 1, or at least may be detached with insignificant restriction.

Figure 4A:
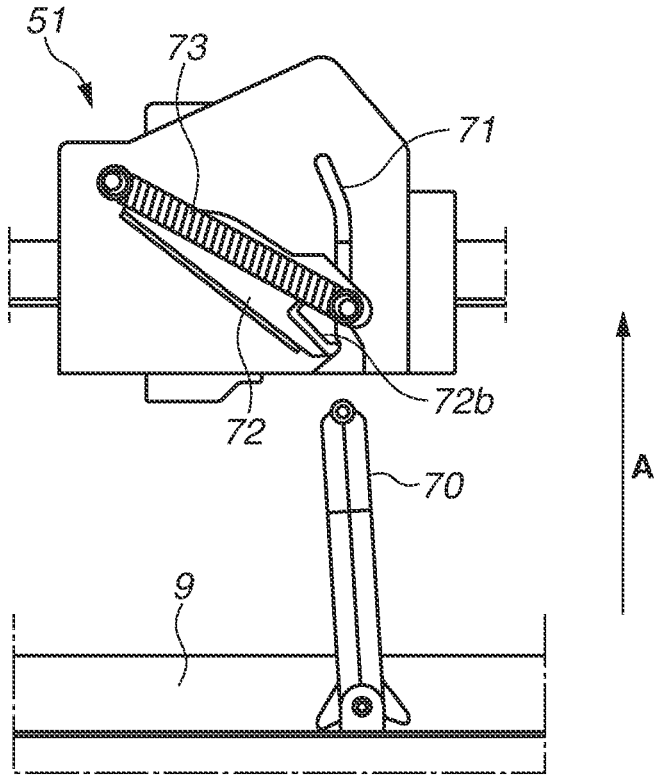
FIGS. 4A and 4B are top views illustrating a configuration of a retraction mechanism.
Figure 4B:
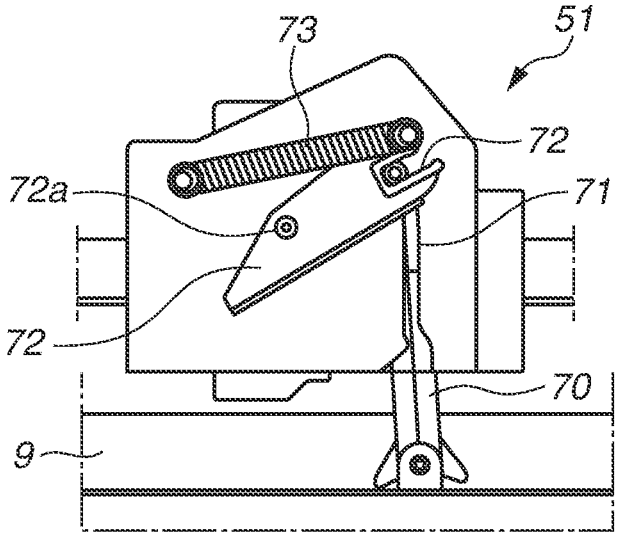

The image forming apparatus 1 is provided with a toggle-type urging mechanism 51 illustrated in FIGS. 4A and 4B which retracts the first cassette 9 to the mounting position so as to reduce a burden on an operator in mounting the first cassette 9 and certainly locate the first cassette 9 at a predetermined mounting position.

The urging mechanism 51 as a retraction unit (a biasing unit) includes a hook 72 which can rotate about a rotation center 72*a* and a spring 73 (an urging unit) which urges the hook 72 as illustrated in FIGS. 4A and 4B. A retraction pin 70 is arranged on a leading edge side of the first cassette 9 in the mounting direction A, in a case where an operator inserts the first cassette 9 in the mounting direction A, the retraction pin 70 of the first cassette 9 is inserted into an engagement groove 72*b* of the hook 72 provided on the apparatus main body 22 as illustrated in FIG. 4B. The retraction pin 70 abuts on an inner wall surface in the engagement groove 72*b* and pushes and rotates the hook 72 about the rotation center 72*a* in a counterclockwise direction in FIG. 4B by resisting a force of the spring 73 in a state illustrated in FIG. 4A.

In a case where the hook 72 is rotated by a predetermined angle about the rotation center 72*a* in the counterclockwise direction in FIG. 4B, the retraction pin 70 is retracted to an inside of the urging mechanism 51 along a guide groove 71 by a tensile force of the spring 73. Accordingly, the first cassette 9 is retracted in the mounting direction indicated by an arrow A in FIG. 2. As described above, in a case where the hook 72 exceeds a predetermined position of the guide groove 71, the spring 73 applies a retraction force (a biasing force) to the first cassette 9. The retraction force of the spring 73 is a force in an opposite direction to the drawing out direction B for drawing out the first cassette 9. In other words, the urging mechanism 51 applies the retraction force to the first cassette 9 in a case where the first cassette 9 is located in a predetermined area (hereinbelow referred to as a retraction area) including the mounting position. In a case where the first cassette 9 is located at a position drawn out from the retraction area in the drawing out direction B, the urging mechanism 51 does not apply the retraction force to the first cassette 9.

The first cassette 9 can store a large number of sheets in response to a high speed operation of the image forming apparatus.

Thus, in a case where the first cassette 9 is fully loaded with sheets, drawing and mounting operations of the first cassette 9 become heavy, so that the urging mechanism 51 for reducing an operation force is arranged.

The urging mechanism 51 fixes a position of the first cassette 9 by urging the first cassette 9 in the mounting direction A for mounting the first cassette 9 in a state in which the first cassette 9 is mounted and stabilizes positional accuracy of an image formed on a sheet.

Another urging mechanism having the same configuration as that of the urging mechanism 51 for the first cassette 9 is arranged to retract the second cassette 91. Further, another urging mechanism having the same configuration as that of the urging mechanism 51 for the first cassette 9 is arranged to retract the third cassette 92.

As illustrated in FIGS. 1A and 2, a cassette front cover 12 is arranged on a front surface in the drawing out direction B of the first cassette 9. The cassette front cover 12 is configured to form an exterior surface aligned on a same plane, in a state in which the first cassette 9 is mounted, as a main body front cover 11 provided on a front surface of the recording unit 6 of the apparatus main body 22 and an exterior surface of the main body front cover 11.

Figure 3:
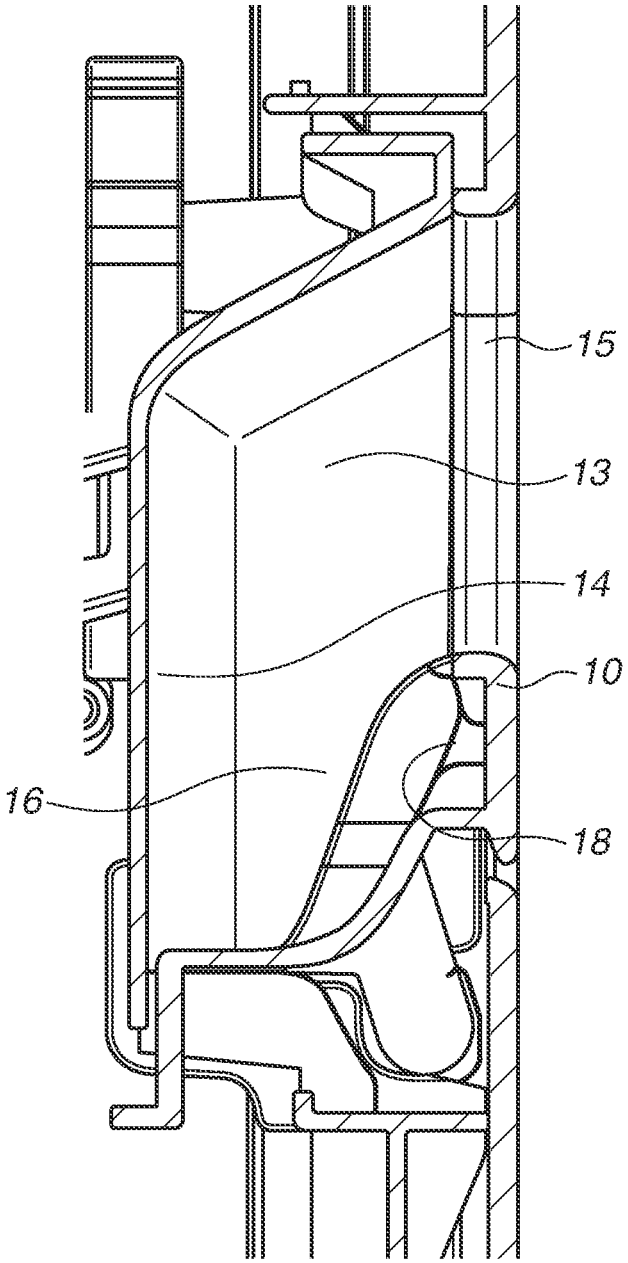
FIG. 3 is a longitudinal section view of a handle of the cassette.

As illustrated in FIG. 2, the cassette front cover 12 includes a rectangular opening portion 13 on a front surface thereof. As illustrated in FIG. 3, the opening portion 13 is provided with a space 15 in an inside direction of the first cassette 9 and a wall surface 14 in a depth side of the space 15. The handle 10 is provided on a lower part of the opening portion 13. The handle 10 includes a finger-hooking surface 16 for hooking a finger to draw out the first cassette 9 on a side facing the wall surface 14. The finger-hooking surface 16 is formed to have a width and a height considering operability for a user in drawing out the first cassette 9. Further, the finger-hooking surface 16 is provided with a rib 18 to make the surface less slippery when a user hooks his/her finger thereon.

Wheels 23 are arranged on a bottom of the image forming apparatus 1. The wheels 23 are arranged to facilitate transportation of the image forming apparatus 1 and the sheet storage apparatus. In this regard, the first cassette 9 may spring out in the drawing out direction B against an urging force of the urging mechanism 51 by an inertial force caused by transportation of the apparatus, an impact when the wheels 23 collide with an irregularity on a passage, and an inclination of the apparatus at a step and the like, and transportation work may be interfered.

Figure 6:
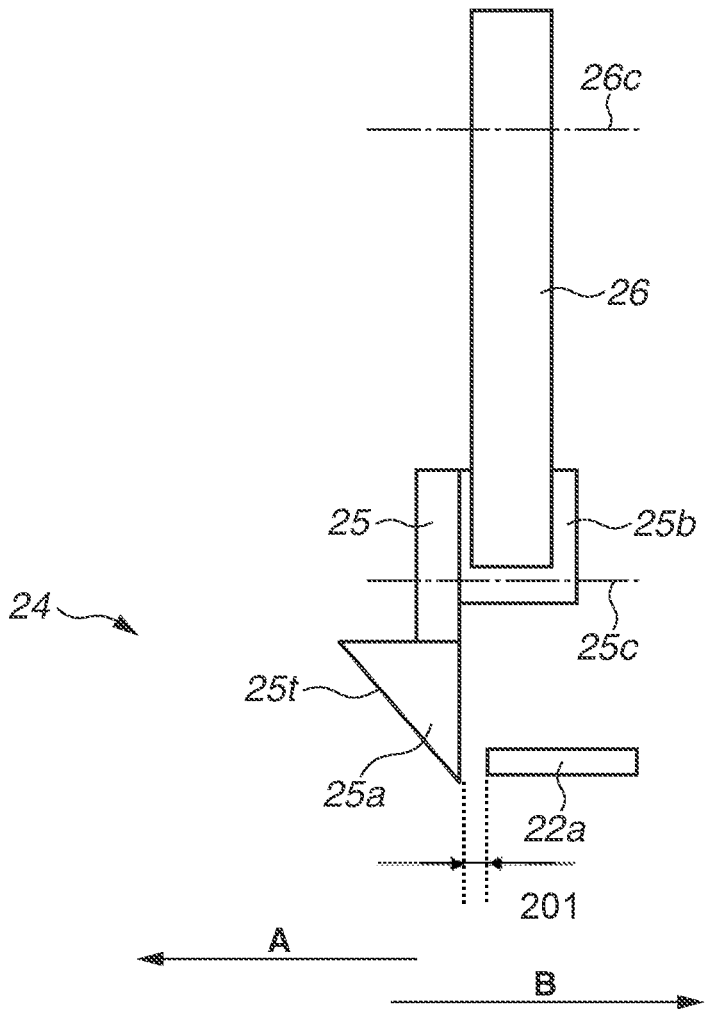
FIG. 6 is a plan view illustrating a locking mechanism.
Figure 7A:
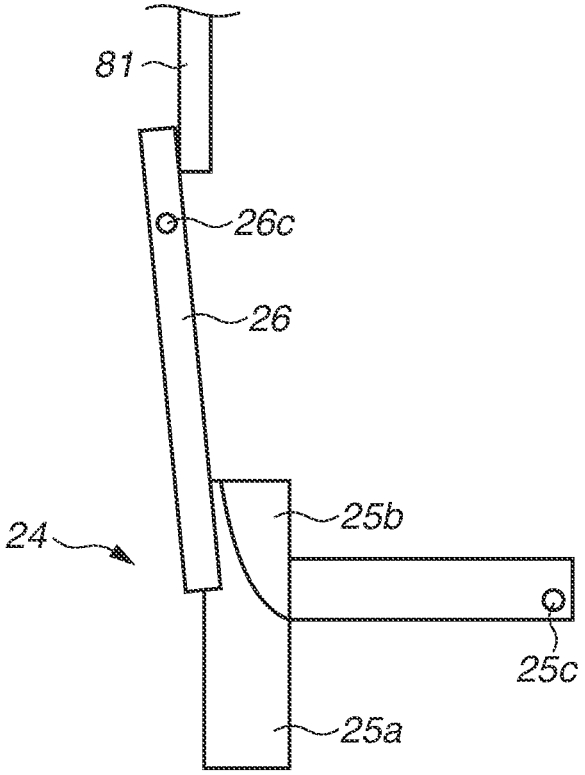
FIGS. 7A and 7B are front views illustrating the locking mechanism.
Figure 7B:
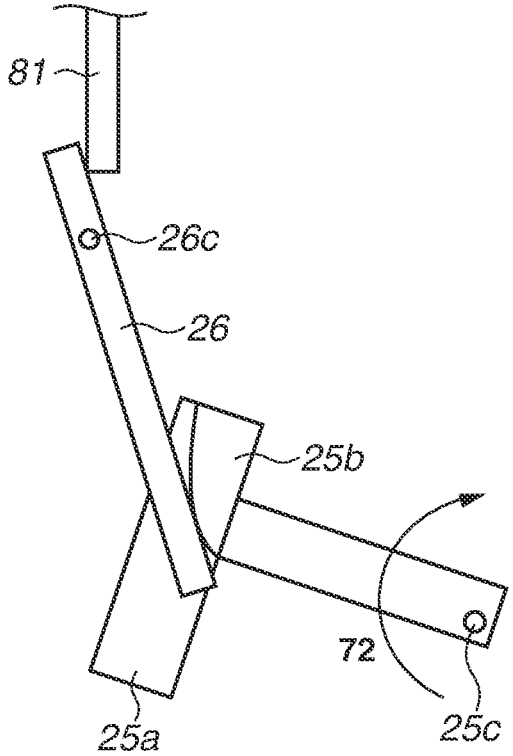
Figure 8:
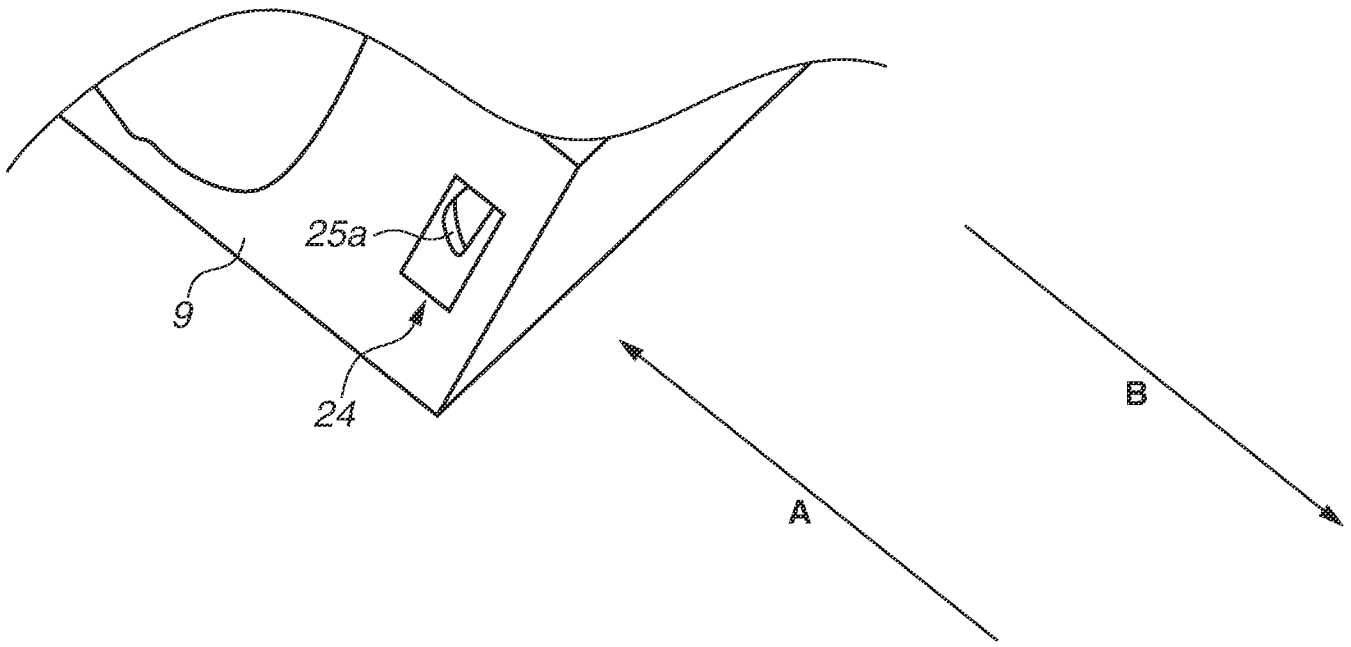
FIG. 8 is a perspective view illustrating the locking mechanism.

Thus, according to the present embodiment, a locking mechanism 24 illustrated in FIGS. 6 to 8, which prevents the first cassette 9 from moving in the drawing out direction B in a state where the first cassette 9 is mounted, is provided in addition to the urging mechanism 51.

FIG. 6 is a top view schematically illustrating a configuration of the locking mechanism 24, FIGS. 7A and 7B illustrate the configuration of the locking mechanism 24 viewed from a direction along the mounting direction A of the first cassette 9.

The locking mechanism 24 includes a locking member 25 provided on the first cassette 9 so as to be freely rotatable about a rotation center 25*c*, or at least may be rotatable with insignificant restriction. The locking member 25 includes an abutting surface 25*b* against which an edge portion of a link member 26 abuts and a latching portion 25*a*. The locking member 25 as a regulating unit can move to a first position at which movement of the first cassette 9 is regulated and to a second position at which the movement of the first cassette 9 is not regulated.

The latching portion 25*a* of the locking member 25 is arranged to be able to protrude from the side of the first cassette 9 (see FIG. 8). The latching portion 25*a* of the locking member 25 abuts against a stopper portion 22*a* of the apparatus main body 22 (see FIG. 6) and thus regulates movement of the first cassette 9 in the drawing out direction B. If an inertial force toward the front of the image forming apparatus 1 is applied to the first cassette 9 during transportation of the image forming apparatus 1, the locking member 25 abuts against the stopper portion 22*a*, and the first cassette 9 does not spring out forward.

In a state in which the first cassette 9 is positioned at the mounting position by the urging mechanism 51, a clearance 201 is secured between the locking member 25 and the stopper portion 22*a*. In a case where the locking member 25 abuts against the stopper portion 22*a* and regulates the position of the first cassette 9, the first cassette 9 is within the retraction area in which the retraction force is applied from the urging mechanism 51 to the first cassette 9.

The latching portion 25*a* has a tapered surface 25*t* which is inclined with respect to a rotational axis of the locking member 25 on the opposite side of a surface abutting against the stopper portion 22*a* of the apparatus main body 22.

Rotation (movement) of the locking member 25 from the first position at which the movement of the first cassette 9 is regulated to the second position at which the movement of the first cassette 9 is not regulated is performed by an operation of the handle 10. According to the present embodiment, the locking member 25 is linked with an operation of an operator who operates the handle 10 using the link member 26.

As illustrated in FIGS. 6, 7A, and 7B, the link member 26 is arranged on the first cassette 9 so as to be freely rotatable about a rotational axis 26*c* which extends horizontally, or at least may be rotatable with insignificant restriction. As illustrated in FIGS. 7A and 7B, an edge portion of the link member 26 can be brought into contact with an engagement portion 81 which is a part of the handle 10, and another edge portion of the link member 26 can be brought into contact with the abutting surface 25*b* of the locking member 25.

Figure 5A:
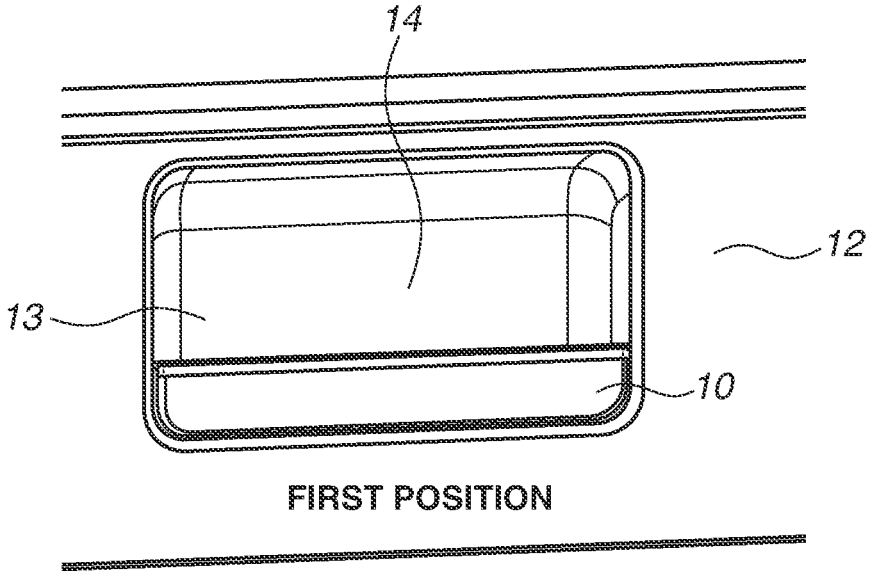
FIGS. 5A and 5B are perspective views illustrating a configuration of the handle.
Figure 5B:
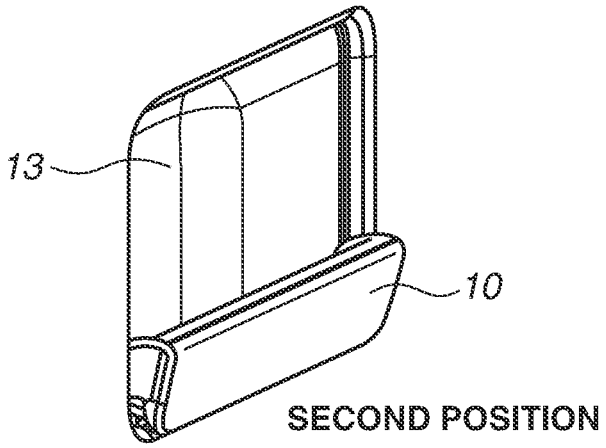

The handle 10 has a rotational axis extending in a horizontal direction, and in a case where the finger-hooking surface 16 is drawn in a direction for drawing out the first cassette 9, the handle 10 is rotated to a front as illustrated in FIG. 5B. A rotatable angle is regulated to about 15 degrees.

The engagement portion 81 provided at a position via the rotation center from the finger-hooking surface 16 of the handle 10 can be brought into contact with the edge portion of the link member 26. As described above, the link member 26 can abut against the locking member 25. A rotational motion of the handle 10 can be linked with a rotational motion of the locking member 25 by the link member 26. Linkage of the handle 10 and the locking member 25 by the link member 26 is described below with reference to FIGS. 7A and 7B.

FIG. 7A illustrates a normal state in which an operator does not operate the handle 10 (a state in which the handle 10 is located at a standby position). FIG. 7B illustrates a state in which an operator operates the handle 10 to the front, and the handle 10 is rotated to a position illustrated in FIG. 5B.

In a case where the handle 10 is rotated in response to an operation by an operator, the engagement portion 81 as the part of the handle 10 moves upward as illustrated in FIG. 7B. The link member 26 is pushed by the engagement portion 81 and rotated. In other words, the link member 26 is rotated so as to rotate the locking member 25 to a position illustrated in FIG. 7B. In FIG. 7B, the latching portion 25*a* of the locking member 25 is retracted to an inside of the first cassette 9 and cannot engage with the stopper portion 22*a* of the apparatus main body 22. The position of the locking member 25 illustrated in FIG. 7A is the first position at which the locking member 25 serving as a locking unit regulates drawing out of the first cassette 9. The position of the locking member 25 illustrated in FIG. 7B is the second position at which the locking member 25 as the locking unit permits drawing out of the first cassette 9.

A spring (not illustrated) for urging the handle 10 is provided so that the handle 10 is located in a normal orientation in a state in which the first cassette 9 is mounted on the apparatus main body 22. In addition, a spring (not illustrated) for urging the locking member 25 is provided so that the locking member 25 is located at the first position. Thus, if the operator releases his/her hand from the handle 10, the locking member 25 is moved to the first position at which the first cassette 9 is regulated.

As described above, in a case where the handle 10 is in the normal orientation, the locking member 25 is located at the first position at which movement of the first cassette 9 is regulated. Further, in a case where the handle 10 is located at a rotated position by being drawn by an operator, the locking member 25 is located at the second position at which the first cassette 9 is not regulated.

In a case where an operator draws out the first cassette 9 so as to store a new sheet in the first cassette 9, the operator hooks his/her fingers on the finger-hooking surface 16 of the handle 10 and draws the handle 10 in the direction for drawing out the first cassette 9. The rotation of the handle 10 by the operator releases locking of the first cassette 9 by the locking member 25 (regulation of movement of the first cassette 9). In other words, the image forming apparatus 1 according to the present embodiment includes the locking mechanism 24 for regulating drawing out of the first cassette 9 in addition to the urging mechanism 51 for improving operability for drawing out and mounting the first cassette 9. Further, release of the locking of the first cassette 9 by the locking member 25 is performed in a series of operations by an operator to draw the handle 10 in the direction for drawing out the first cassette 9.

Accordingly, the image forming apparatus 1 according to the present embodiment can ensure excellent workability in transportation work of the apparatus main body 22 without impairing excellent operability of the first cassette 9 in drawing out and mounting operations.

As described above, in a case where the locking member 25 abuts against the stopper portion 22*a* and regulates the position of the first cassette 9, the first cassette 9 is within the retraction area in which the retraction force is applied from the urging mechanism 51 to the first cassette 9. If the first cassette 9 is likely to move from the mounting position in the drawing out direction B during transportation of the image forming apparatus 1, the locking member 25 abuts against the stopper portion 22*a* and regulates the movement of the first cassette 9 in the drawing out direction B. When an external force applied to the first cassette 9 is lost after the movement of the first cassette 9 in the drawing out direction B is regulated by the locking member 25, the first cassette 9 is positioned at the mounting position by the retraction force from the urging mechanism 51.

In a case where the first cassette 9 is inserted in the mounting direction A, the locking member 25 operates as follows. The tapered surface 25*t* of the locking member 25 abuts against the stopper portion 22*a* of the apparatus main body 22, and the locking member 25 rotates in a direction of an arrow 72 see FIG. 7B) along with insertion of the first cassette 9. Therefore, insertion of the first cassette 9 is not hampered by the locking member 25. In other words, the locking member 25 is configured to permit insertion of the first cassette 9 into the apparatus main body 22 in a state where an operator does not directly operate the handle 10.

Motions of the handle 10 and the locking member 25 are not limited to rotation and can be straight motions.

An edge of a portion via the rotation center from a portion of the finger-hooking surface 16 of the handle 10 can be the locking member 25. In other words, the handle 10 and the locking member 25 can be formed in an integral member.

According to the present embodiment, the second cassette 91 includes neither a locking member for locking the second cassette 91 at the mounting position so as not to be drawn out nor a member corresponding to a lever member for linking a handle with the locking member. The third cassette 92 includes neither a locking member for locking the third cassette 92 at the mounting position so as not to be drawn out nor a member corresponding to a lever member for linking a handle with the locking member. The number of sheets that the second and the third cassettes 91 and 92 can store are small as compared to that of the first cassette 9, and there is less possibility that the second and the third cassettes 91 and 92 spring out during transportation of the apparatus as compared to the first cassette 9. Thus, the locking members are not arranged in the second and the third cassettes 91 and 92 to reduce costs.

According to the present embodiment, a surface of the handle 10 on the opposite side of the finger-hooking surface 16 is an appearance surface. The appearance surface of the handle 10 is arranged so as to be aligned on substantially the same plane as the exterior surface of the cassette front cover 12 of the first cassette 9.

Since the handle 10 is rotated, a clearance is provided between the cassette front cover 12 and a surrounding of the appearance surface of the handle 10. Accordingly, a user can predict, by the appearance thereof, that the handle 10 is a handle for drawing out the first cassette 9, and the handle 10 may be rotated or moved.

In addition, the appearance surface of the handle 10 is arranged so as to be aligned on substantially the same plane as the exterior surface of the cassette front cover 12 in a case where the handle 10 is in the normal orientation, and thus an excellent appearance design of the apparatus can be obtained. The sheet storage apparatus according to the present embodiment rarely interferes with transportation work. For example, in the conventional art where an apparatus main body is transported and moved, there is a risk that the cassette springs out from the apparatus main body due to an inertial force and an impact caused by transportation and movement. In such a case, transportation work may be interfered. In contrast, in the present disclosure, the first cassette 9 may spring out in the drawing out direction B against an urging force of the urging mechanism 51 by an inertial force caused by transportation of the apparatus, an impact when the wheels 23 collide with an irregularity on a passage, and an inclination of the apparatus at a step and the like, and transportation work may be interfered. The image forming apparatus 1 can ensure excellent workability in transportation work of the apparatus main body 22 without impairing excellent operability of the first cassette 9 in drawing out and mounting operations.

While the present disclosure has been described with reference to embodiments, it is to be understood that the disclosure is not limited to the disclosed embodiments. The scope of the following claims is to be accorded the broadest interpretation so as to encompass all such modifications and equivalent structures and functions.

This application claims the benefit of Japanese Patent Application No. 2018-065367, filed Mar. 29, 2018, which is hereby incorporated by reference herein in its entirety.

What is claimed is:

1. An image forming apparatus comprising:

an image forming unit configured to form an image on a sheet;

a cassette configured to store sheets and to be drawn out from a mounting position in a drawing out direction with respect to an apparatus body;

a feeding unit configured to feed a sheet in the cassette positioned at the mounting position toward the image forming unit;

a biasing unit configured to apply a biasing force to the cassette to bias the cassette toward the mounting position;

a handle provided on the cassette and configured to be movable and to be operated by an operator; and a locking member movably provided on the cassette and configured to interlock with the handle, wherein, in a case where the handle is not operated by the operator, the locking member is positioned at a first position where the locking member regulates movement of the cassette in the drawing out direction by abutment against a stopper portion provided in the apparatus body, wherein, in a case where the handle is operated and moved by the operator, the locking member is positioned at a second position where the locking member allows the movement of the cassette in the drawing out direction, wherein, in a state in which the cassette is positioned at the mounting position and the locking member is positioned at the first position where the locking member regulates movement of the cassette in the drawing out direction by the abutment, a clearance is secured between the locking member and the stopper portion, wherein, when an external force is applied to the cassette and the locking member abuts against the stopper portion, the cassette is within an area in which the biasing force is applied by the biasing unit, and wherein the cassette moves from a position where the locking member abuts against the stopper portion to the mounting position by the biasing force applied by the biasing unit.

2. The image forming apparatus according to claim 1, wherein, in a case where the cassette is located in a first area including the mounting position, the biasing unit applies the biasing force to the cassette, wherein, in a case where the cassette is located in a second area on a side of the drawing out direction than the first area, the biasing unit does not apply the biasing force to the cassette, and wherein the locking member regulates movement of the cassette in a state in which the cassette is located in the first area.

3. The image forming apparatus according to claim 1, wherein the locking member is configured to permit insertion of the cassette into the mounting position in a state in which the operator does not operate the handle.

4. The image forming apparatus according to claim 1, wherein the cassette is a first cassette and the biasing unit is a first biasing unit, the image forming apparatus further comprising:

a second cassette configured to store sheets and to be moved so as to be drawn out in the drawing out direction, wherein the second cassette is configured to store sheets of which number is less than that of the first cassette which is regulated movement thereof by the locking member; and a second biasing unit configured to apply a biasing force to the second cassette so that the second cassette is biased toward a mounting position at which the second cassette is mounted to the image forming apparatus, wherein a regulating unit configured to regulate movement of the second cassette from the mounting position in the drawing out direction is not arranged.

5. The image forming apparatus according to claim 1, wherein the handle is rotatable around a rotational axis extending in a horizontal direction.

6. The image forming apparatus according to claim 1, wherein the locking member includes a latching portion which abuts against the stopper portion, the latching portion protrudes from a side of the cassette in a state that the locking member is positioned at the first position, and the latching portion retracts into the cassette in a state that the locking member is positioned at the second position.

7. A sheet storing apparatus comprising:

an apparatus body;

a cassette configured to store a sheet, wherein an image to be formed on the sheet is stored in the cassette by an image forming unit, and wherein the cassette is able to be drawn out from a mounting position in a drawing out direction with respect to the apparatus body;

a biasing unit configured to apply a biasing force to the cassette to bias the cassette toward the mounting position;

a handle provided on the cassette and configured to be movable and to be operated by an operator; and a locking member provided on the cassette and configured to interlock with the handle, wherein, in a case where the handle is not operated by the operator, the locking member is positioned at a first position where the locking member regulates movement of the cassette in the drawing out direction by abutment against a stopper portion provided in the paratus body, wherein, in a case where the handle is operated and moved by the operator, the locking member is positioned at a second position where the locking member allows movement of the cassette in the drawing out direction, wherein, in a state in which the cassette is positioned at the mounting position and the locking member is positioned at the first position where the locking member regulates movement of the cassette in the drawing out direction, a clearance is secured between the locking member and the stopper portion, and wherein, when an external force is applied to the cassette and the locking member abuts against the stopper portion, the cassette is within an area in which the biasing force is applied by the biasing unit, and wherein the cassette moves from a position where the locking member abuts against the stopper portion to the mounting position by the biasing force applied by the biasing unit.

* * * * *